US005081719A

United States Patent [19]

Donnelly

[11] Patent Number: 5,081,719

[45] Date of Patent: Jan. 21, 1992

[54] MOTORCYCLE SAFETY BELT

[76] Inventor: Charles E. Donnelly, 4811 Steamboat Cir., Rapid City, S. Dak. 57702

[21] Appl. No.: 519,811

[22] Filed: May 7, 1990

[51] Int. Cl.[5] ..... A41F 9/00

[52] U.S. Cl. ..... 2/311; 2/312; 2/322; 182/3

[58] Field of Search ..... 2/322, 312, 319, 318, 2/317, 321, 311, 337; 280/290; 180/268, 273; 182/3

[56] References Cited

U.S. PATENT DOCUMENTS

| | | | |
|---|---|---|---|
| 3,052,890 | 9/1962 | Miller | 2/337 |
| 3,487,474 | 1/1970 | De Meo | 2/311 |
| 3,533,107 | 10/1970 | Raneri et al. | 2/311 |
| 3,564,616 | 2/1971 | Battaglia | 2/311 |
| 3,840,902 | 10/1974 | McNeill | 2/311 |
| 3,896,499 | 7/1975 | Kelly | 2/311 |
| 3,940,801 | 3/1976 | Riggs et al. | 2/311 |
| 4,028,742 | 6/1977 | Marquis | 2/311 |
| 4,396,013 | 8/1983 | Hasslinger | 128/845 |
| 4,413,358 | 11/1983 | Jimenez | 2/321 |
| 4,429,419 | 2/1984 | Snyder | 280/290 |
| 4,560,097 | 12/1985 | Reynolds et al. | 280/290 |
| 4,625,334 | 12/1986 | Proffer | 2/311 |
| 4,666,017 | 5/1987 | Zimmerman | 182/3 |

FOREIGN PATENT DOCUMENTS

| | | | |
|---|---|---|---|
| 106078 | 11/1926 | Austria | 280/290 |
| 175799 | 1/1953 | Austria | 2/321 |
| 883502 | 10/1971 | Canada | 2/311 |
| 2630393 | 10/1989 | France | 280/290 |
| 245428 | 6/1926 | United Kingdom | 182/3 |
| 733898 | 7/1955 | United Kingdom | 2/337 |
| 2140276 | 11/1984 | United Kingdom | 182/3 |

OTHER PUBLICATIONS

Atlas Safety Equipment Co., Inc., Catalogue 65, No. 341,342.

*Primary Examiner*—Werner H. Schroeder
*Assistant Examiner*—Michael A. Neas
*Attorney, Agent, or Firm*—Leon Gilden

[57] ABSTRACT

A belt construction is set forth, including an elongate flexible belt member defined by a constant predetermined height, including hook and loop fasteners at opposed terminal free ends of the belt for securement of the belt rearwardly of a driver of a motorcycle. The belt includes a plurality of securement handles slidably mounted about the belt for grasping by a passenger of the motorcycle. Each handle includes a rectangular plate-like framework, with a medially positioned central support flange defining spaced openings, wherein one of the openings includes a locking flange mounted at an obtuse angle relative to a side leg plate of the support flange for locking securement of the handle member relative to the belt during use.

4 Claims, 4 Drawing Sheets

PRIOR ART

MOTORCYCLE SAFETY BELT

BACKGROUND OF THE INVENTION

1. Field of the Invention

The field of invention relates to motorcycle belt structure, and more particular pertains to a new and improved motorcycle safety belt wherein the same utilizes a plurality of positionable handles relative to an elongate belt for manual grasping thereof by a passenger of an associated motorcycle.

2. Description of the Prior Art

Safety belt structure for use with motorcycles has been provided in the prior art to permit a passenger of a motorcycle to grasp a handle arrangement mounted to a belt to be worn by a driver of the associated motorcycle. Examples of prior art devices may be found in U.S. Pat. No. 4,413,358 to Jimenez wherein a fixed buckle arrangement secures opposed ends of a first belt member thereto, wherein a second web portion mounted medially of the belt member captures a plurality of spaced handles in a fixed relationship relative to the belt member.

U.S. Pat. No. 3,896,499 to Kelly sets forth a relatively wide belt for encircling outer garments of a driver of a vehicle, wherein vertical flexible loops are selectively secured and grasped by a rider of the vehicle that is positioned rearwardly of the driver.

U.S. Pat. No. 4,396,013 to Hasslinger provides a flexible belt arrangement for encircling a mid-section of a driver of a tandemly seated vehicle, such as a motorcycle, utilizing a plurality of handles fixedly secured to the belt for grasping by a passenger.

U.S. Pat. No. 3,840,902 to McNeill sets forth a safety belt for motorcycles utilizing a rearwardly positioned shock absorbing cushion to minimize impact between a passenger and a driver of a motorcycle, as well as fixedly mounting a handle positioned to each side of the motorcycle, wherein the invention, as is conventional with other prior art devices, utilizes a buckle arrangement mounted to the belt for positioning the buckle forwardly of the driver of the motorcycle, as opposed to the instant invention positioning the belt rearwardly of the driver to minimize loss of use of the belt during inadvertent unbuckling of the belt structure.

As such, it may be appreciated that there continues to be a need for a new and improved motorcycle safety belt arrangement wherein the same permits relative repositioning of handle structure mounted to an associated belt and sets forth the organization in a compact structure of effective use and coordination in a motorcycle riding environment and in this respect, the present invention substantially fulfills this need.

SUMMARY OF THE INVENTION

In view of the foregoing disadvantages inherent in the known types of motorcycle safety belt structures now present in the prior art, the present invention provides a motorcycle safety belt wherein the same permits selective positioning of handles relative to a driver of a motorcycle for securement thereof by a passenger, and further including a polymeric relatively soft friction lining laminated to an interior surface of the belt to enhance frictional engagement with the driver of the motorcycle. As such, the general purpose of the present invention, which will be described subsequently in greater detail, is to provide a new and improved motorcycle safety belt which has all the advantages of the prior art motorcycle safety belt structures and none of the disadvantages.

To attain this, the present invention provides a belt construction, including an elongate flexible belt member defined by a constant predetermined height, including hook and loop fasteners at opposed terminal free ends of the belt for securement of the belt rearwardly of a driver of a motorcycle. The belt includes a plurality of securement handles slidably mounted about the belt for grasping by a passenger of the motorcycle. Each handle includes a rectangular plate-like framework, with a medially positioned central support flange defining spaced openings, wherein one of said openings includes a locking flange mounted at an obtuse angle relative to a side leg plate of the support flange for locking securement of the handle member relative to the belt during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motorcycle safety belt which has all the advantages of the prior art motorcycle safety belt structures and none of the disadvantages.

It is another object of the present invention to provide a new and improved motorcycle safety belt which may be easily and efficiently manufactured and marketed.

It is a further object of the present invention to provide a new and improved motorcycle safety belt which is of a durable and reliable construction.

An even further object of the present invention is to provide a new and improved motorcycle safety belt which is susceptible of a low cost of manufacture with regard to both materials and labor, and which accordingly is then susceptible of low prices of sale to the consuming public, thereby making such motorcycle safety belts economically available to the buying public.

Still yet another object of the present invention is to provide a new and improved motorcycle safety belt which provides in the apparatuses and methods of the prior art some of the advantages thereof, while simultaneously overcoming some of the disadvantages normally associated therewith.

Still another object of the present invention is to provide a new and improved motorcycle safety belt wherein the same is fastened to a mid-section of a driver of an associated motorcycle, with the clasp portions of the belt directed rearwardly of the wearer of the belt utilizing a plurality of spaced handles selectively mounted about the belt and latched thereto during tension applied to handle structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
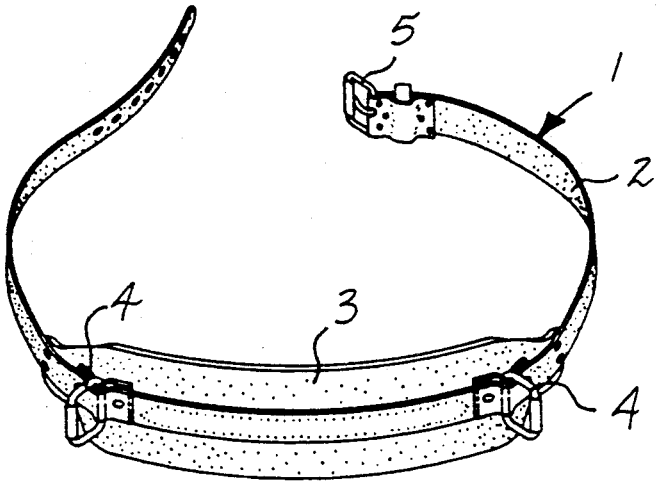
FIG. 1 is an isometric illustration of a prior art motorcycle safety belt arrangement.

With reference now to the drawings, and in particular to FIGS. 1 to 8 thereof, a new and improved motorcycle safety belt embodying the principles and concepts of the present invention and generally designated by the reference numeral 10 will be described.

Figure 2:
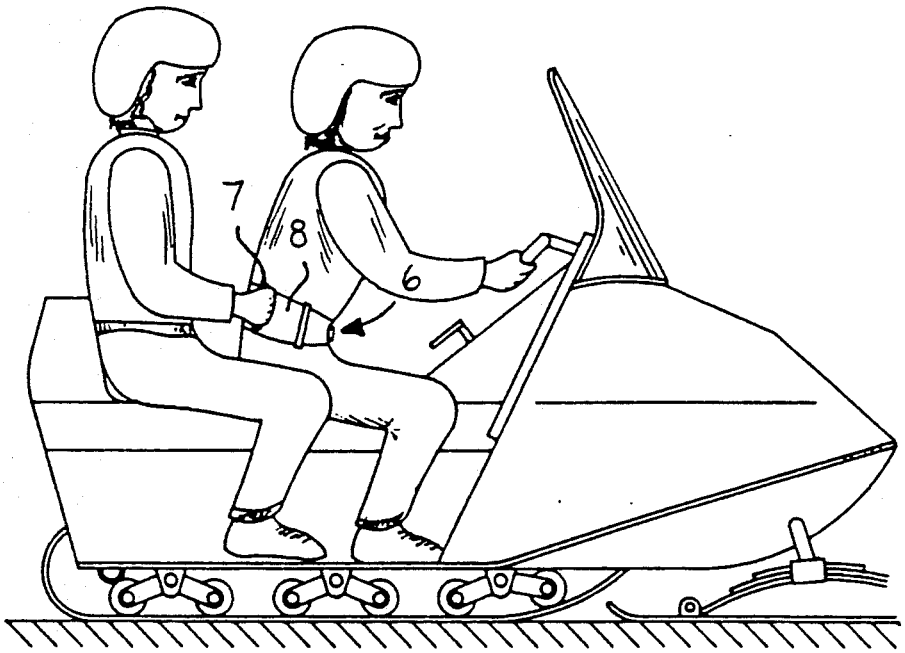
PRIOR ART FIG. 2
FIG. 2 is a further prior art example of a safety belt arrangement utilized in a vehicle employing tandem passenger seats.

FIG. 1 illustrates a prior art safety belt arrangement 1, wherein a flexible belt 2 includes an enlarged web 3 to capture a plurality of fixed handles 4 between the web and the belt structure, with the buckle portion 5 of the belt arranged for securement to a forward portion of an individual. FIG. 2 illustrates a further prior art safety belt structure 6, wherein a relatively wide belt 8 includes fixed handles 7 of flexible construction mounted to rear portions of the belt structure.

Figure 3:
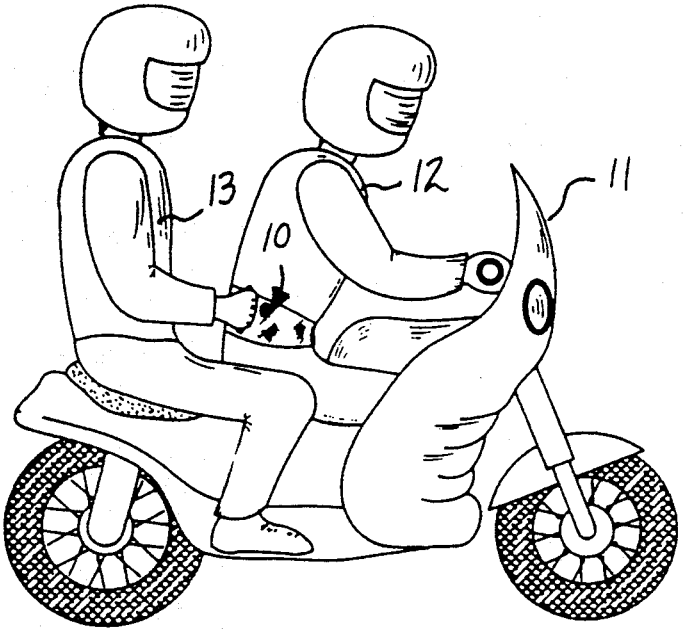
FIG. 3 is an orthographic view, taken in elevation, of the instant invention secured to a driver of a motorcycle for grasping by a passenger.
Figure 4:
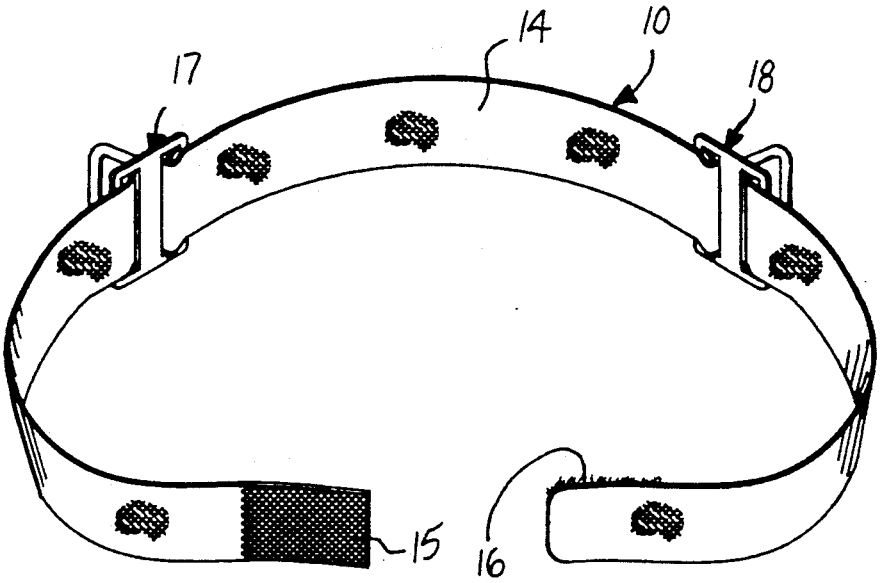
FIG. 4 is an isometric illustration of the instant invention.

More specifically, the motorcycle safety belt apparatus 10 of the instant invention is typically mounted to a driver 12 of the motorcycle 11 for manual grasping of a passenger 13, as illustrated in FIG. 3. The safety belt structure 10 of the instant invention essentially comprises a flexible belt web 14 defined by a finite length and formed of interwoven fiber of polymeric construction or alternatively of a natural flexible material, such as leather, defined by an interior surface coextensive with an exterior surface. The belt web 14 is defined by a predetermined and fixed cross-sectional configuration, including a first end 15 formed with a first hook and loop fastener surface mounted to an exterior surface of the belt at the first end 15 cooperative with a second end 16 formed with a second hook and loop fastener surface mounted to an interior surface of the belt 14 at the second end 16 to permit adjustable and selective securement of the first and second ends together in a rapid and easily operable manner. Further it should be noted that the first and second ends 15 and 16 are arranged for securement about a back surface of an individual, as opposed to the forward portion of a driver's mid-section such that inadvertent disengagement of the first and second ends relative to one another maintains operative use of the belt structure and minimizes its disengagement from the driver 12. Further, a first handle member 17 and a second handle member 18 are slidably mounted along the belt web 14 for selective positioning therealong for grasping by the passenger 13. Typically, it is generally desired that the handles be positioned about the forward mid-section of the driver in use, but may alternatively be positioned rearwardly thereof for convenience by a passenger.

Figure 5:
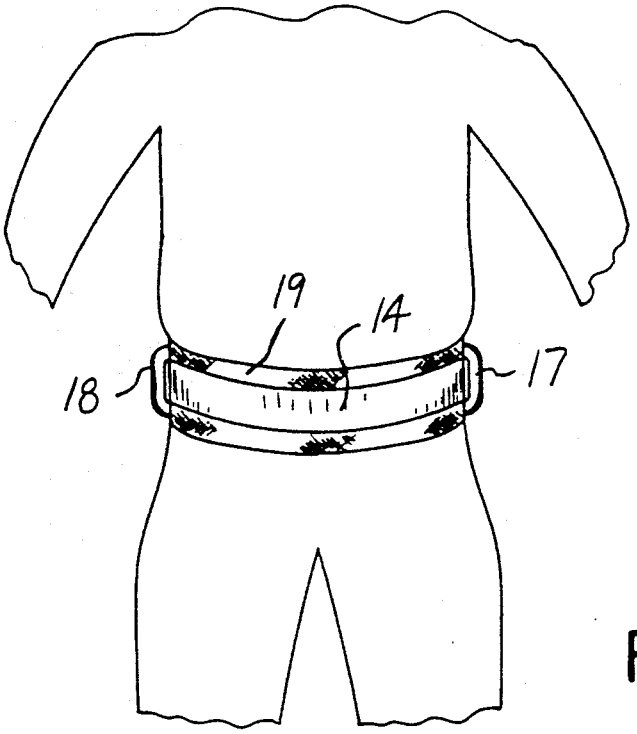
FIG. 5 is an orthographic view, taken in elevation, of the belt illustrated with the buckle arrangement mounted rearwardly of the wearer of the belt.
Figure 6:
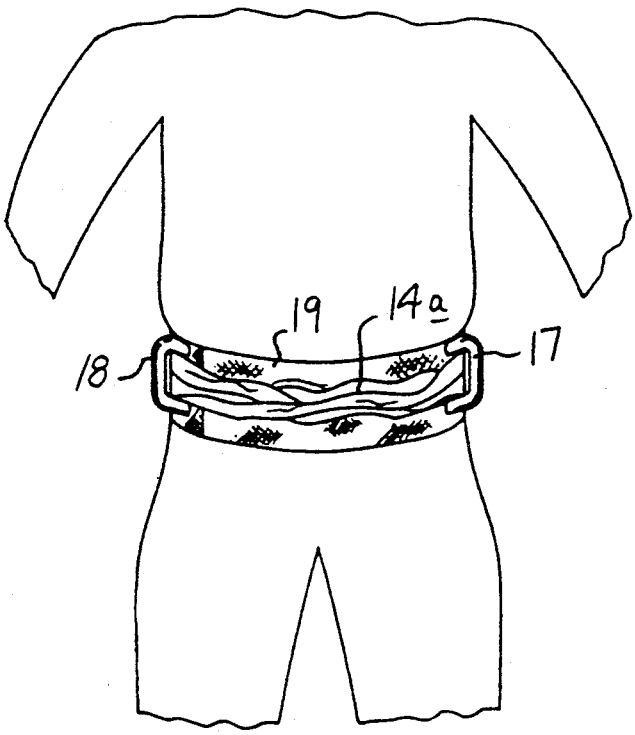
FIG. 6 is an orthographic view, taken in elevation, of the instant invention utilizing an interwoven belt structure.
Figure 7:
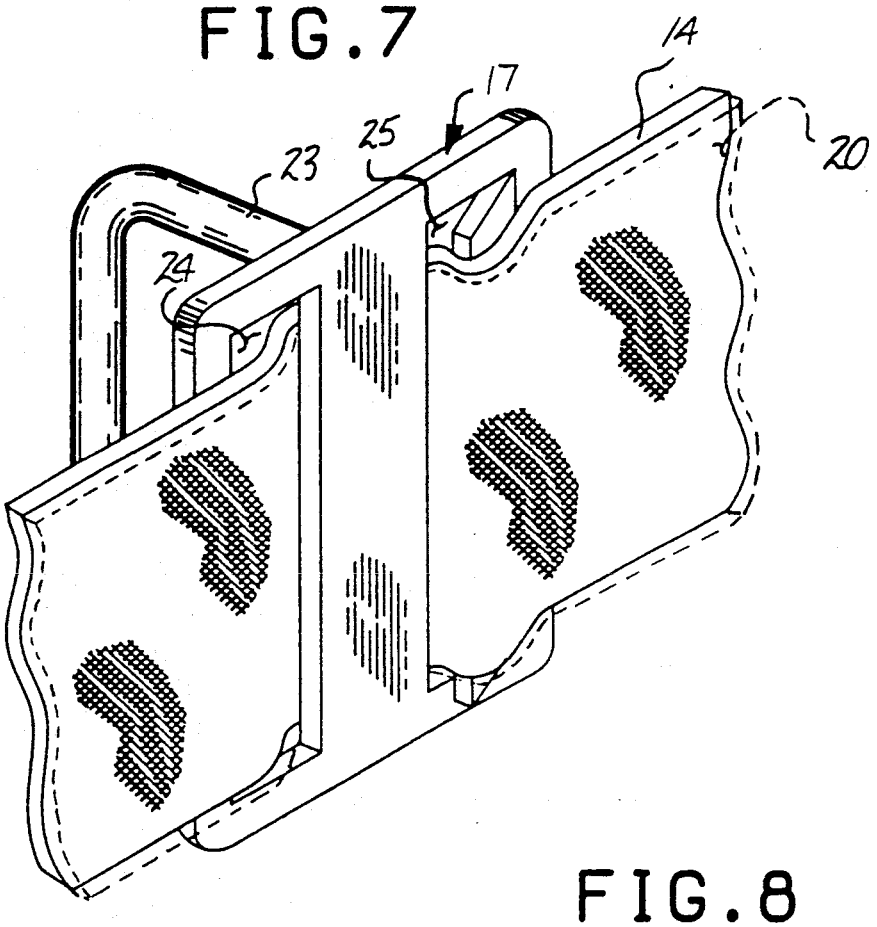
FIG. 7 is an isometric illustration of the handle member structure utilized by the instant invention.

FIG. 5 illustrates the belt web 14 overlying an associated interior web support 19, wherein alternatively the use of an interwoven belt web **14*a*** is illustrated, wherein the interwoven structure is defined of a greater tensile strength for effecting a greater margin of safety in use of the organization.

Figure 8:
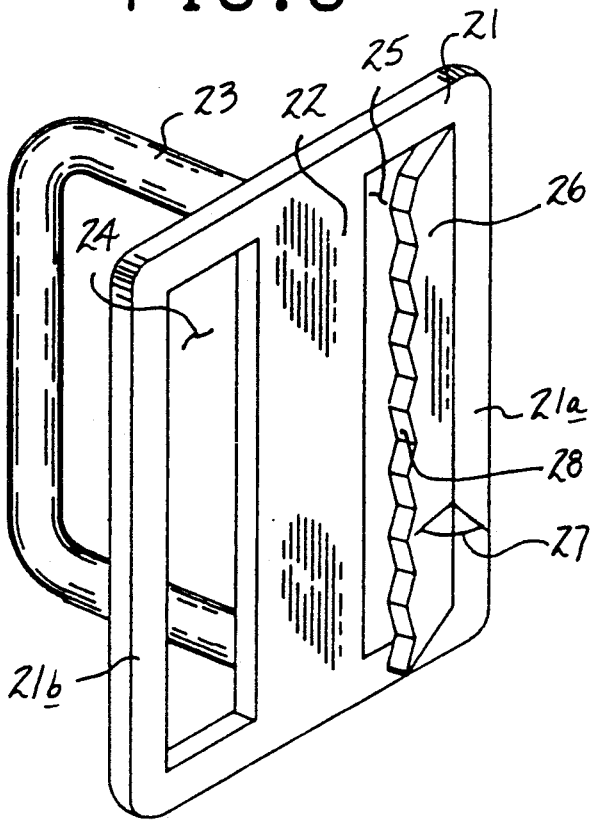
FIG. 8 is an isometric illustration of the handle member structure of the instant invention.

The belt web 14 is formed with a resilient polymeric friction layer 20 (see FIG. 7) laminated coextensively to the interior surface of the belt web 14. The frictional layer 20 enhances positioning of the belt web when mounted about the driver 12, as well as assisting in affixing each of the first and second handles 17 and 18 relative to the belt web member 14 in use. It should be noted that the first and second handle members 17 and 18 are of identical construction, and wherein their configuration and construction is illustrated in FIG. 8 in greater detail for purposes of understanding.

Each handle member includes a planar support frame 21 of a generally rectangular configuration defined by a first opening 24 and a second opening 25, each defined by a predetermined height substantially equal to a predetermined height defined by the belt web member 14. The planar support frame 21 includes parallel top and bottom leg plates arranged parallel relative to one another, and includes a central support flange 22 orthogonally bisecting each of the top and bottom leg plates and arranged generally parallel to side leg plates defining the support frame. Further, the support flange 22 is arranged in the same plane as defines the support frame 21. A "U" shaped handle 23 is orthogonally and fixedly mounted to an exterior surface of the central support flange 22, wherein the central support flange in cooperation with the support frame 21 defines the first and second openings 24 and 25. The first opening 24 is of a generally rectangular configuration, as is the second opening 25. The second opening 25 includes a rigid locking flange 26 fixedly mounted to a right leg plate 21*a* of the support frame 21 and defining an obtuse included angle 27 between an interior surface of the right leg plate 21*a* and the locking flange 26, wherein the locking flange 26 extends in an opposed direction relative to the plane defined by the support frame 21 as that of the "U" shaped handle 23. The locking flange 26 further includes a series of serrated teeth 28 formed at a free end of the flange overlying the second opening 25. In use, each of the second openings 25 of the first and second handle members are directed interiorly of the belt and facing towards one another, whereas the first openings 24 are directed to opposed respective ends defined by the first and second ends 14 and 15 of the belt web 14. In this manner, grasping of the handles 23 by a passenger 13 ensures engagement with the serrated teeth 28 to interlock the handle members 17 and 18 relative to the belt web during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motorcycle safety belt comprising, an elongate flexible belt web defined by a finite length, and further defined by a fixed and constant cross-sectional configuration including a predetermined height, the belt web including a first end and a second end, the first and second ends selectively securable together, and a first handle member and a second handle member slidably mounted along the belt web, wherein the first and second handle members each include locking means for selective securement of the first and second handle members to the belt web, and wherein the belt web includes an interior surface and an exterior surface, wherein the interior and exterior surfaces are coextensive relative to one another along the belt web, and the belt web includes a first hook and loop fastener surface formed to the exterior surface of the belt web at the first end, and a second hook and loop fastener surface selectively securable to the first hook and loop fastener surface formed to the interior surface of the belt web at the second end, and wherein the first and second handle members each include a planar support frame, the planar support frame including spaced and parallel top and bottom legs spaced apart the predetermined height defined by the belt web, and further including a left leg and a right leg, each arranged parallel relative to one another and orthogonally and integrally formed to the top and bottom legs to define the planar support frame, and a central support flange orthogonally bisecting and aligned in the same plane as the top and bottom legs, wherein the central support flange defines a first opening and a second opening between respective left and right legs of the support frame, and further including a "U" shaped handle orthogonally and fixedly mounted to an exterior surface of the central support flange extending rearwardly of the planar support frame.

2. A motorcycle safety belt as set forth in claim 1 wherein the locking means includes a locking flange fixedly mounted to the right leg and extending overlying the first opening, the locking flange defines an obtuse angle between an interior surface of the right leg and an interior surface of the locking flange, wherein the locking flange extends at an opposed orientation relative to the support frame relative to the "U" shaped handle.

3. A motorcycle safety belt as set forth in claim 2 wherein the locking flange includes a series of serrated teeth at a free end of the locking flange overlying the first opening.

4. A motorcycle safety belt as set forth in claim 3 wherein the first openings of each handle member are directed interiorly of the belt web and in a confronting relationship relative to one another, wherein the second openings of the respective first and second handle members are directed towards the respective first and second ends of the belt web.

* * * * *